US007503432B2

(12) United States Patent
Chida

(10) Patent No.: US 7,503,432 B2
(45) Date of Patent: Mar. 17, 2009

(54) ELEVATOR CONTROL USING CLOCK SIGNAL

(75) Inventor: Akihiro Chida, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 522 days.

(21) Appl. No.: 10/554,320

(22) PCT Filed: Feb. 25, 2004

(86) PCT No.: PCT/JP2004/002175

§ 371 (c)(1),
(2), (4) Date: Oct. 24, 2005

(87) PCT Pub. No.: WO2005/080249

PCT Pub. Date: Sep. 1, 2005

(65) Prior Publication Data

US 2007/0012522 A1 Jan. 18, 2007

(51) Int. Cl.
*B66B 1/28* (2006.01)

(52) U.S. Cl. ..... 187/248; 187/393

(58) Field of Classification Search ..... 187/247, 187/248, 380–388, 391–393
See application file for complete search history.

(56) References Cited

U.S. PATENT DOCUMENTS 4,350,225 A * 9/1982 Sakata et al. ..... 187/248
7,237,653 B2 * 7/2007 Chida ..... 187/248

FOREIGN PATENT DOCUMENTS

| | | | |
|---|---|---|---|
| EP | 1762530 | A1 * | 3/2007 |
| JP | 53-089149 | | 8/1978 |
| JP | 8-119553 | | 5/1996 |
| JP | 08119553 | A * | 5/1996 |
| JP | 2000-009767 | | 1/2000 |

* cited by examiner

*Primary Examiner*—Jonathan Salata
(74) *Attorney, Agent, or Firm*—Buchanan Ingersoll & Rooney PC

(57) ABSTRACT

An elevator control device has: a processing portion for controlling an operation of an elevator based on a clock signal; and a detection portion for comparing the number of edges of the clock signal counted within a preset period of time with the preset number of edges to detect a condition of the clock signal to issue an instruction related to the operation of the elevator to the processing portion in accordance with the detection results.

15 Claims, 2 Drawing Sheets

ELEVATOR CONTROL USING CLOCK SIGNAL

RELATED APPLICATIONS

This application claims priority under 35 U.S.C. §371 to PCT Application No. PCT/JP2004/002175 filed as an International Application on Feb. 25, 2004 designating the U.S., the entire contents of which are hereby incorporated by reference in their entireties.

TECHNICAL FIELD

The present invention relates to an elevator control device and an elevator control method for controlling an operation of an elevator.

BACKGROUND ART

In a conventional counter of an elevator control device, as described in JP 53-89149 A for example, when a counted value of a clock signal reaches a preset value, a counting circuit outputs a coincidence signal representing that both the values have coincided with each other to an output circuit. Then, the counting circuit outputs the coincidence signal to the output circuit, thereby adjusting timing at which the elevator control device controls an operation of the elevator.

However, for example, when the clock signal been moved to an abnormal state due to a stop or the like of the clock signal, the counting circuit cannot determine the counted value of the clock signal by calculation, and thus the elevator control device cannot properly control the operation of the elevator.

The present invention has been made in order to solve the inconvenience as described above, and it is, therefore, an object of the present invention to obtain an elevator control device and an elevator control method which are capable of suitably controlling an operation of an elevator in accordance with an operational condition of a clock signal.

DISCLOSURE OF THE INVENTION

According to one aspect of the present invention, there is provided an elevator control device, comprising: a processing portion for controlling an operation of an elevator based on a clock signal; and a detection portion for detecting a condition of the clock signal counted within a preset period of time to issue an instruction related to the operation of the elevator to the processing portion based on the condition of the clock signal detected.

According to another aspect of the present invention, there is provided an elevator control device, comprising: a processing portion for controlling an operation of an elevator based on a clock signal; a counter portion for counting the number of edges of the clock signal within a present period of time; a setting portion for setting the number of edges of the clock signal as a reference to be used for detecting a condition of the clock signal; and a detection portion for comparing the number of edges counted by the counter portion with the number of edges set in the setting portion to detect the condition of the clock signal to issue an instruction related to the operation of the elevator to the processing portion in accordance with the condition of the clock signal detected.

According to a still further aspect of the present invention, there is provided an elevator control method, comprising: a control step for controlling an operation of an elevator based on a clock signal; a detection step for detecting a condition of the clock signal counted within a preset period of time; and an instruction step for issuing an instruction related to the operation of the elevator based on results detected through the detection step.

BEST MODE FOR CARRYING OUT THE INVENTION

Hereinafter, an embodiment of the present invention will be described based on the drawings.

Figure 1:
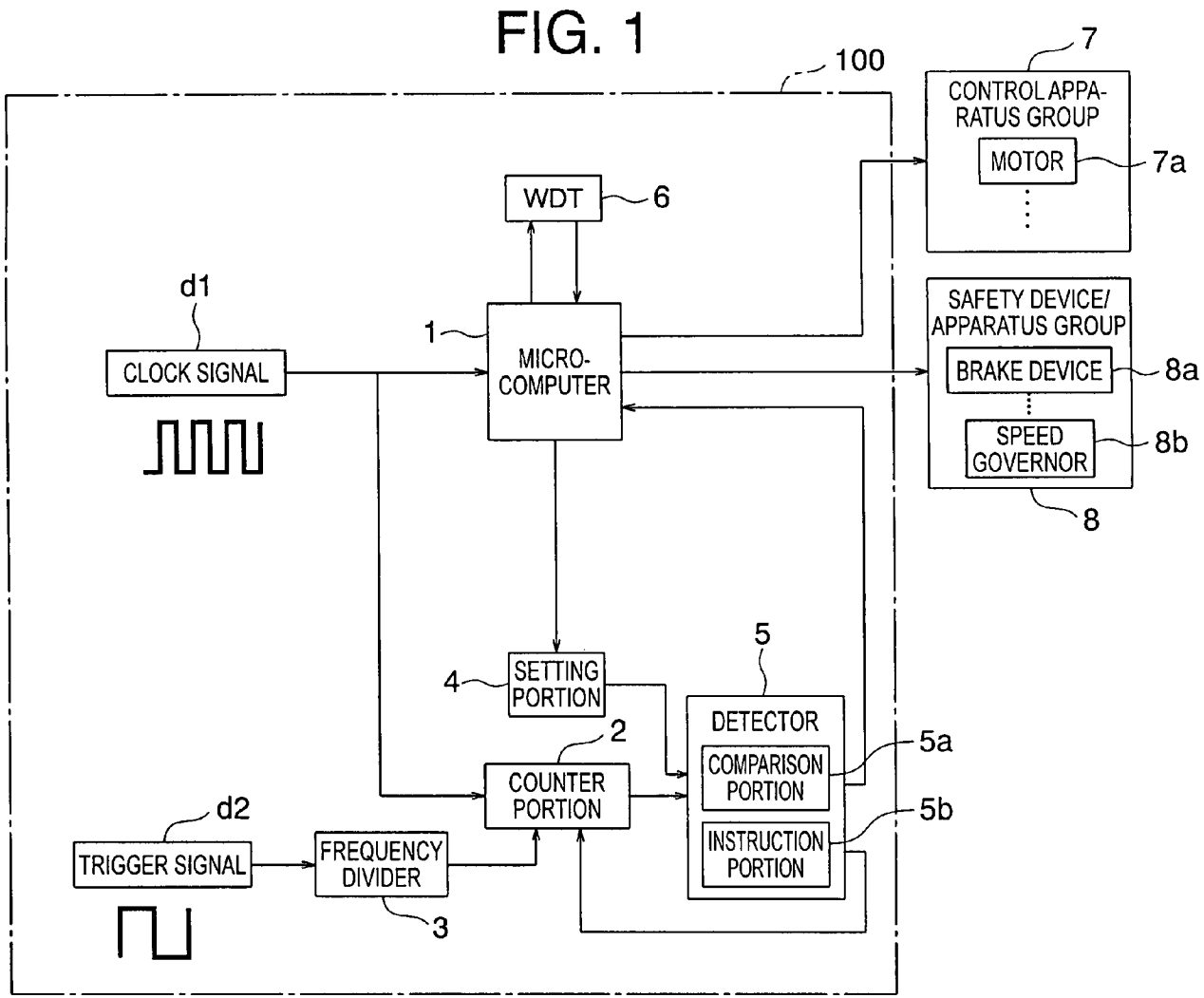
FIG. 1 is a block diagram showing an elevator control device according to an embodiment of the present invention.

FIG. 1 is a block diagram showing an elevator control device 100 according to an embodiment of the present invention. In this embodiment, a description will be given on the assumption that the elevator control device 100 is incorporated in an elevator control panel.

In FIG. 1, the elevator control device 100 has a microcomputer (processing portion) 1, a counter portion 2, a frequency divider 3, a setting portion 4, a detector (detection portion) 5, and watch dog timer (WDT) 6.

The microcomputer 1 controls a control apparatus group 7 and a safety device/apparatus group 8 synchronously with a clock signal d1 so as to maintain the elevator in a safe state. In this embodiment, a process in which the microcomputer 1 carries out the control is referred to as a control step.

The control apparatus group 7 includes, for example, a motor (driving portion) 7*a* for a traction machine. In addition, the safety device/apparatus group 8 includes, for example, a brake device 8*a* and a governor 8*b*.

The clock signal d1 is a signal which is alternately repeated in a high level and a low level at regular intervals, and is generated by a generator (not shown). In addition, the clock signal d1 has a rising edge and a trailing edge of a voltage. In this embodiment, the microcomputer 1, for example, operates synchronously with the rising edge of the voltage of the clock signal d1. In other words, the clock signal d1 is used as a driving clock of the microcomputer 1.

For example, the microcomputer 1 counts the number of pulses obtained in an encoder of the motor 7*a* or counts the number of pulses obtained in an encoder of the governor 8*b*, within a predetermined period of the clock signal d1, to control a speed arithmetic operation or an operation of a car.

The counter portion 2 counts the number of rising edges of the clock signal d1. In this embodiment, the counter portion 2 counts the number of rising edges of the clock signal d1 every predetermined period in accordance with a trigger signal d2, a frequency of which is converted into a predetermined frequency by the frequency divider 3. Note that the trigger signal d2 is generated by a generator (not shown).

More specifically, the counter portion 2 counts the number of rising edges of the clock signal d1 using the rising edge of the trigger signal d2, which is alternately repeated in a high level and a low level at regular intervals, as a trigger. That is, the counter portion 2 counts the number of rising edges of the clock signal d1 with setting a period of time from an arbitrary rising edge of the trigger signal d2 to a next rising edge of the trigger signal d2 as one period.

The frequency divider 3 converts the frequency of the trigger signal d2 into the predetermined frequency, thereby making the number of edges of the clock signal d1 easy to count.

The setting portion 4, for example, is a register or the like. The number of edges d3 of the clock signal d1 in a normal state is set in the setting portion 4 in advance by the microcomputer 1. The number of edges d3 of the clock signal d1 is a reference value used for detecting a condition of the clock signal d1, i.e., normality or abnormality of the clock signal d1. The number of edges d3 of the clock signal d1 can be changed to an arbitrary value by the microcomputer 1. In this embodiment, "the number of edges of the clock signal d1 in the normal state" between two rising edges of the trigger signal d2 is set as the number of edges d3 in advance.

Note that the number of edges d3 is registered in the setting portion 4 by the microcomputer 1 when an operator specifies the number of edges d3 to be set in the setting portion 4 by manipulating the microcomputer 1, for example. In this embodiment, a process for setting the number of edges d3 in the setting portion 4 is referred to as a setting step.

The detector 5 transmits a signal to the microcomputer 1 in accordance with the condition of the clock signal d1, i.e., the normality or abnormality of the clock signal d1. The detector 5 includes a comparison portion 5*a* and an instruction portion 5*b*. Functions of the comparison portion 5*a* and the instruction portion 5*b* are as follows.

The comparison portion 5*a* compares the number of edges counted by the counter portion 2 with the number of edges set in the setting portion 4 to detect the condition of the clock signal d1. The instruction portion 5*b* transmits a signal related to the abnormality or normality to the microcomputer 1 in accordance with the detection results obtained by the comparison portion 5*a*.

The WDT 6 monitors the microcomputer 1. More specifically, when the pulse from the microcomputer 1 has not been inputted for a preset period of time, i.e., when the microcomputer 1 is unable to operate, the WDT 6 outputs a reset signal to the microcomputer 1.

Figure 2:
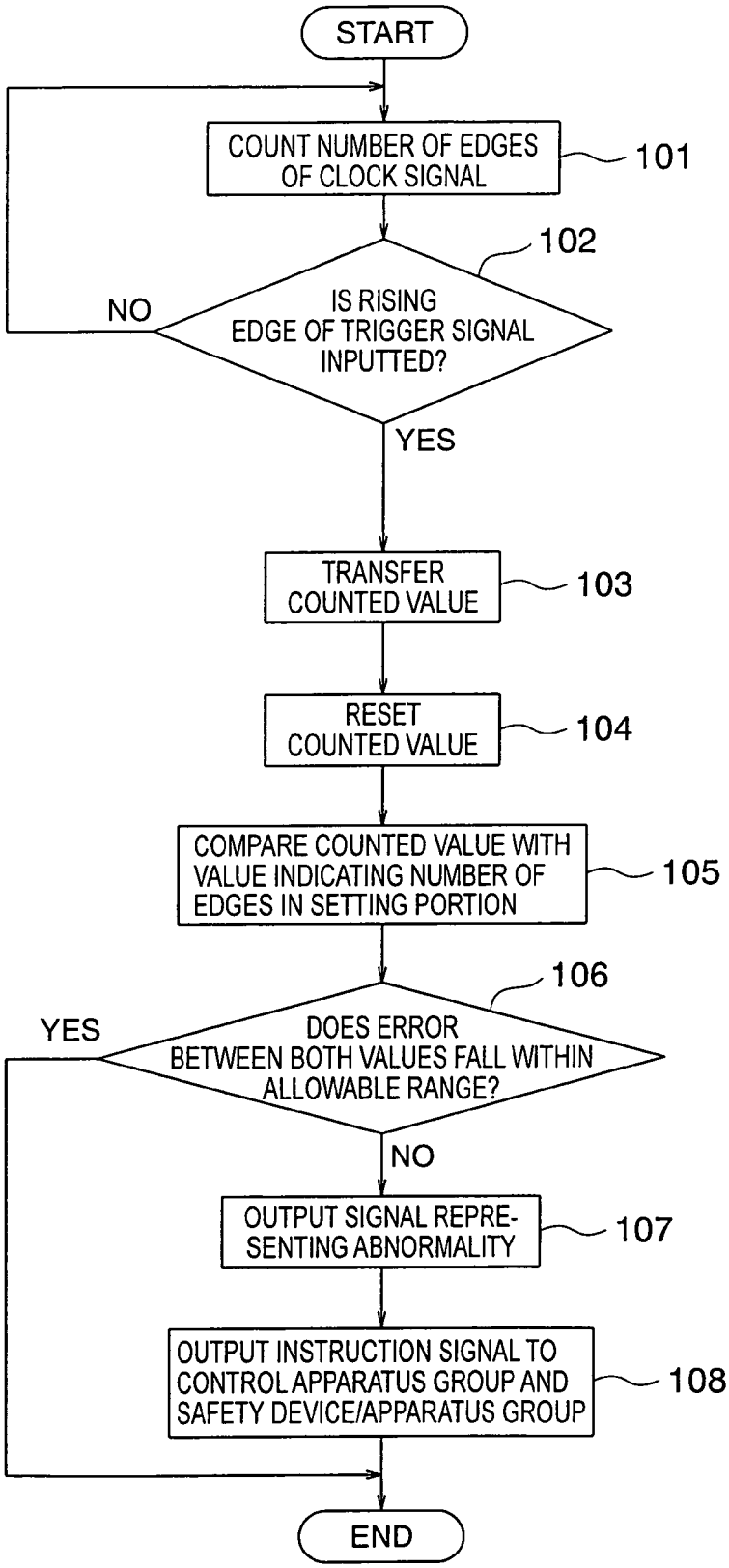
FIG. 2 is a flow chart showing an operation of the elevator control device shown in FIG. 1.

FIG. 2 is a flow chart showing a method of controlling the elevator control device 100.

The counter portion 2 counts the number of rising edges of the clock signal d1, with which the microcomputer 1 operates in synchronization (a count step 101).

The count portion 2 continues to count the number of rising edges of the clock signal d1 unless the counter portion 2 receives an input of the rising edge of the trigger signal d2, the frequency of which is converted into the predetermined frequency by the frequency divider 3. That is, the counter portion 2 counts the number of rising edges of the clock signal d1 every interval of the rising edges of the trigger signal d2.

Then, when receiving an input of the rising edge of the trigger signal d2 (an input step 102), the counter portion 2 latches a counted value indicating the number of edges counted by the counter portion 2 and transfers the counted value thus latched to the detector 5 (a transfer step 103). Then, the counter portion 2 resets the counted value (a reset step 104).

Next, the comparison portion 5*a* compares the counted value transferred thereto from the detector 5 with the value indicated by the number of edges d3 which is set in the setting portion 4 in advance (a comparison step 105) to judge whether or not an error between the counted value and the value indicated by the number of edges d3 falls within a preset allowable range (e.g., within ±2%) (a judgment step 106). That is, the comparison portion 5*a* detects the condition of the clock signal d1, i.e., abnormality or normality of the clock signal d1 through the comparison step 105 and the judgment step 106. Note that the comparison step 105 and the judgment step 106 are collectively referred to as a detection step.

Then, when it is judged in the comparison portion 5*a* that the error between both the values falls within the allowable range, the instruction portion 5*a* transmits a signal representing normality of the clock signal d1 to the microcomputer 1. On the other hand, when it is judged in the comparison portion 5*a* that the error between both the values is out of the allowable range, the instruction portion 5*a* transmits a signal representing abnormality of the clock signal d1 to the microcomputer 1 (an output step 107). Note that the comparison portion 5*a* may clear the counted value in the counter portion 2 when it is judged in the comparison portion 5*a* that the error between both the values falls within the allowable range.

Next, the microcomputer 1 outputs a predetermined instruction signal to at least one of the control apparatus group 7 and the safety device/apparatus group 8 in accordance with the signal issued by the instruction portion 5*b* (an instruction step 108).

For example, the microcomputer 1 outputs an instruction signal to stop the motor 7*a* in accordance with the signal issued by the instruction portion 5*b*. In addition, the microcomputer 1 outputs an instruction signal to the brake device 8*a* to cause the brake device 8*a* to carry out the braking operation. Thus, the microcomputer 1 outputs the instruction signal to any one of the control apparatus group 7 and the safety device/apparatus group 8, thereby stopping the car.

As described above, in the elevator control device 100 of this embodiment, the microcomputer 1 has the control step for controlling the operation of the elevator based on the clock signal d1. The counter portion 2 has the count step for counting the number of edges of the clock signal d1 within the predetermined period of time based on the trigger signal d2. In addition, the detector 5 has the detection step for detecting the condition of the clock signal d1 by comparing the number of edges counted by the counter portion 2 with the number of edges d3 set in the setting portion 4, and the instruction step for issuing the instruction related to the operation of the elevator to the microcomputer 1 in accordance with the detection results.

For this reason, when the abnormality of the clock signal d1 is detected by the detector 5, the microcomputer 1 can carry out the control so as to suitably drive the control apparatus group 7 and the safety device/apparatus group 8. Accordingly, the microcomputer 1 can suitably control the operation of the elevator in accordance with the operational condition of the clock signal d1.

Further, the detector 5 detects the operational condition of the clock signal d1 based on the number of edges of the clock signal d1. Therefore, unlike the case of the WDT 6, even when the period of the clock signal d1 is shortened (in case of shortening of the period), the detector 5 can detect this situation as the abnormality of the clock signal d1. In addition, for example, when the period of the clock signal d1 is lengthened and when the clock signal d1 is stopped, the detector 5 can detects those situations as the abnormalities of the clock signal d1. For this reason, the microcomputer 1 can carry out the control so as to suitably drive the control apparatus group 7 and the safety device/apparatus group 8 in accordance with various abnormalities of the clock signal d1.

For example, even when the period of the clock signal d1 changes from 10 ms to 5 ms, a situation can be prevented where the microcomputer 1 misinterprets a decrease in number of pulses obtained in the encoder of the motor 7*a* as that the speed of the car is reduced to half of the normal speed and causes the car traveling at an over-speed to collide with a buffer.

In addition, the detector 5 compares the number of edges of the clock signal d1 counted within the preset period of time with the preset number d3 of edges to detect the condition of the clock signal d1, and issues the instruction related to the operation of the elevator to the microcomputer 1 in accordance with the detection results. Thus, the microcomputer can suitably control the operation of the elevator in accordance with the operational state of the clock signal d1.

In addition, when detecting the abnormality based on the detection of the condition of the clock signal d1, the detector 5 issues the instruction to the microcomputer 1 to stop the motor 7*a*. Thus, when the clock signal d1 enters the abnormal state, the motor 7*a* is stopped to stop the car so that the car enters the safe state.

Also, when detecting the abnormality based on the detection of the condition of the clock signal d1, the detector 5 issues the instruction to the microcomputer 1 to cause the brake device 8*a* to carry out control operation. Thus, when the clock signal d1 enters the abnormal state, the car is stopped by the braking operation of the brake device 8*a* so that the car becomes the safe state.

Moreover, since the number of edges d3 set in the setting portion 4 can be changed to an arbitrary value, the detector 5 can detect the operational condition of the clock signal d1 in accordance with the clock signal having various frequencies.

Note that in the above-mentioned embodiment, when detecting the stop of the clock signal d1 as the abnormality of the clock signal d1, the detector 5 may issue an instruction to the microcomputer 1 to stop the operation of the elevator. In this case, when the clock signal d1 stops, the car is stopped so that the elevator is moved to the safe state. However, when the microcomputer 1 is inoperable due to the stop of the clock signal d1, the WDT 6 may output an interrupt signal to the microcomputer 1 to reset the microcomputer 1.

In addition, the case has been described where the counter portion 2 counts the number of rising edges of the clock signal d1. However, for example, the counter portion 2 may count the number of the trailing edges of the clock signal d1.

Also, the case has been described where the frequency divider 3 changes the frequency of the trigger signal d2. However, for example, the frequency divider 3 may change the frequency of the trigger signal d2.

The invention claimed is:

1. An elevator control device, comprising:

a processing portion for controlling an operation of an elevator based on a clock signal; and a detection portion for detecting a condition of the clock signal counted within a preset period of time to issue an instruction related to the operation of the elevator to the processing portion based on the condition of the clock signal detected.

2. The elevator control device according to claim 1, wherein the detection portion issues an instruction to the processing portion to stop the operation of the elevator when detecting an abnormality based on detection of the condition of the clock signal.

3. The elevator control device according to claim 1, wherein the detection portion issues an instruction to the processing portion to stop the driving portion of the elevator when detecting an abnormality based on detection of the condition of the clock signal.

4. The elevator control device according to claim 1, wherein the detection portion issues an instruction to the processing portion to cause the brake device to carry out control operation of the elevator when detecting an abnormality based on detection of the condition of the clock signal.

5. The elevator control device according to claim 1, wherein the detection portion compares a number of edges of the clock signal with a preset number of edges when detecting the condition of the clock signal counted within the preset period of time.

6. The elevator control device according to claim 5, wherein the preset number of edges can be changed to an arbitrary value.

7. An elevator control device, comprising:

a processing portion for controlling an operation of an elevator based on a clock signal;

a counter portion for counting the number of edges of the clock signal within a preset period of time;

a setting portion for setting the number of edges of the clock signal as a reference to be used for detecting a condition of the clock signal; and a detection portion for comparing the number of edges counted by the counter portion with the number of edges set in the setting portion to detect the condition of the clock signal to issue an instruction related to the operation of the elevator to the processing portion in accordance with the condition of the clock signal detected.

8. An elevator control method, comprising:

a control step for controlling an operation of an elevator based on a clock signal;

a detection step for detecting a condition of the clock signal counted within a preset period of time; and an instruction step for issuing an instruction related to the operation of the elevator based on results detected through the detection step.

9. The elevator control method according to claim 8, wherein when it is detected through the detection step that the condition of the clock signal is abnormal, an instruction to stop the operation of the elevator is issued through the instruction step.

10. The elevator control method according to claim 8, wherein when it is detected through the detection step that the condition of the clock signal is abnormal, an instruction to stop the driving portion of the elevator is issued through the instruction step.

11. The elevator control method according to claim 8, wherein when it is detected through the detection step that the condition of the clock signal is abnormal, an instruction to cause the brake portion to carry out control operation of the elevator is issued through the instruction step.

12. The elevator control method according to claim 8, wherein a number of edges of the clock signal counted within the preset period of time is compared with a preset number of edges through the detection step.

13. The elevator control method according to claim 12, further comprising a setting step for setting the preset number of edges to an arbitrary value.

14. An elevator control device, comprising:

a processing portion for controlling an operation of an elevator based on a clock signal; and a detection portion for detecting a condition of the clock signal counted within a preset period of time to issue an instruction related to the operation of the elevator to the processing portion based on the condition of the clock signal detected;

wherein the detection portion compares a number of edges of the clock signal with a preset number of edges when detecting the condition of the clock signal counted within the preset period of time.

15. An elevator control method, comprising:

a control step for controlling an operation of an elevator based on a clock signal;

a detection step for detecting a condition of the clock signal counted within a preset period of time; and an instruction step for issuing an instruction related to the operation of the elevator based on results detected through the detection step;

wherein a number of edges of the clock signal counted within the preset period of time is compared with a preset number of edges through the detection step.

* * * * *